US009877888B1

(12) United States Patent
Sosebee

(10) Patent No.: US 9,877,888 B1
(45) Date of Patent: Jan. 30, 2018

(54) DEVICE FOR IMPROVING MOBILITY

(71) Applicant: William Sosebee, North Little Rock, AR (US)

(72) Inventor: William Sosebee, North Little Rock, AR (US)

( * ) Notice: Subject to any disclaimer, the term of this patent is extended or adjusted under 35 U.S.C. 154(b) by 0 days.

(21) Appl. No.: 15/720,965

(22) Filed: Sep. 29, 2017

(51) Int. Cl.
*A61H 3/00* (2006.01)
*A45B 9/02* (2006.01)

(52) U.S. Cl.
CPC ..... *A61H 3/00* (2013.01); *A45B 9/02* (2013.01); *A61H 2003/006* (2013.01)

(58) Field of Classification Search
CPC ..... A61H 3/00; A61H 2003/006; A45B 9/02
See application file for complete search history.

(56) References Cited

U.S. PATENT DOCUMENTS 4,767,141 A * 8/1988 Martin ..... A01B 1/02 294/181
5,924,434 A * 7/1999 Cato, III ..... A61H 3/02 135/68
6,044,507 A * 4/2000 Smith ..... A61G 7/1038 248/158
6,820,628 B2 * 11/2004 Larson ..... A01B 1/02 135/66
6,834,660 B1 * 12/2004 Van Wart, Jr. ..... A61H 3/02 135/72
7,451,775 B1 * 11/2008 Werner, III ..... A45B 9/02 135/65

FOREIGN PATENT DOCUMENTS

DE 102014004163 A1 * 9/2015 ..... A45B 9/00

* cited by examiner

*Primary Examiner* — Noah Chandler Hawk
(74) *Attorney, Agent, or Firm* — Wright, Lindsey & Jennings LLP; K. Brandon Middleton

(57) ABSTRACT

A device for improving the mobility of a user, the device having a main support structure such as a shaft or pole and a number of support appendages such as rings or cuffs attached to the main support structure such that the support appendages extend on various sides of the support structure. The support appendages provide support to the forearm, wrist, or other point of contact on the user's body when the user grasps the main support structure.

12 Claims, 2 Drawing Sheets

DEVICE FOR IMPROVING MOBILITY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Millions of Americans rely on devices designed to assist and improve their mobility. These devices may include, for example, canes and walkers, which allow people with a mobility impairment or disability to regain independence and increase their standard of living.

BRIEF SUMMARY OF THE INVENTION

The present invention is directed to a mobility assistance device, and more particularly to a support device configured to provide the user with a sturdy support base, assisting the user with standing or walking. It is an object of the present invention to provide a device to aid mobility impaired users in regaining and maintaining a better, safer state of balance. The device is useful for assisting users in various mobility functions, including walking, using stairs, or simply moving from a sitting position to a standing position. While the device may be useful for any user having a mobility impairment, the device may be particularly useful for users who have suffered a stroke resulting in the impairment of their upper extremities. The design of the device allows for these users to recover the use of their impaired arms when carrying out mobility functions. The device is designed to provide a better support base than traditional mobility devices.

These and other objects, features, and advantages of the present invention will become better understood from a consideration of the following detailed description of the preferred embodiments and appended claims in conjunction with the drawings as described following:

DETAILED DESCRIPTION OF THE INVENTION

Figure 1:
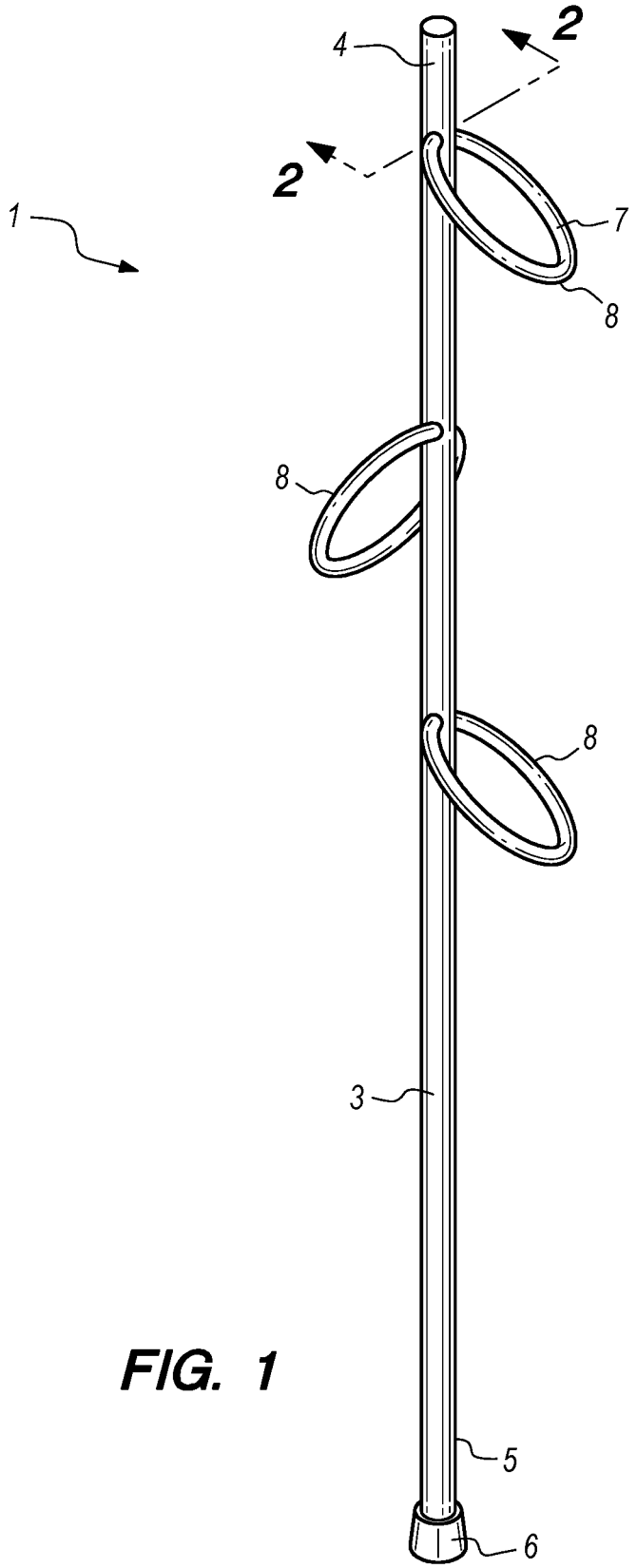
FIG. 1 is drawing showing one embodiment of the mobility device of the present invention.

The present invention is directed to a mobility assistance device, and more particularly to a support device configured to provide the user with a sturdy support base, assisting the user with standing or walking.

Generally speaking, the mobility device 1 of the present invention comprises a main support structure 3 and a number of support appendages 8 positioned on or attached to the main support structure 3. In various embodiments the mobility device 1 may have a single support appendage 8 or multiple support appendages 8. The main support structure 3, for example, may be a substantially vertical shaft or pole made of a durable and sturdy material such as wood, metal, or composite material. The main support structure 3 acts as a support base for the user. In this regard, the main support structure 3 is configured such that its lower end 5 extends completely to the floor or other walking surface and the upper end 4 (end opposite the lower end 5) extends to a position near the upper body of the user. In the preferred embodiment, the upper end 4 extends to a height near to the height of the user. In one embodiment, the height of the support structure 3 is between 60 inches to 72 inches, but other heights may be used to customize the mobility device 1 according to the height of the intended user. Furthermore, one embodiment of the mobility device 1 includes a rubber cap 6 at the extreme lower end 5 to facilitate a stronger grip with the walking surface.

Figure 3:
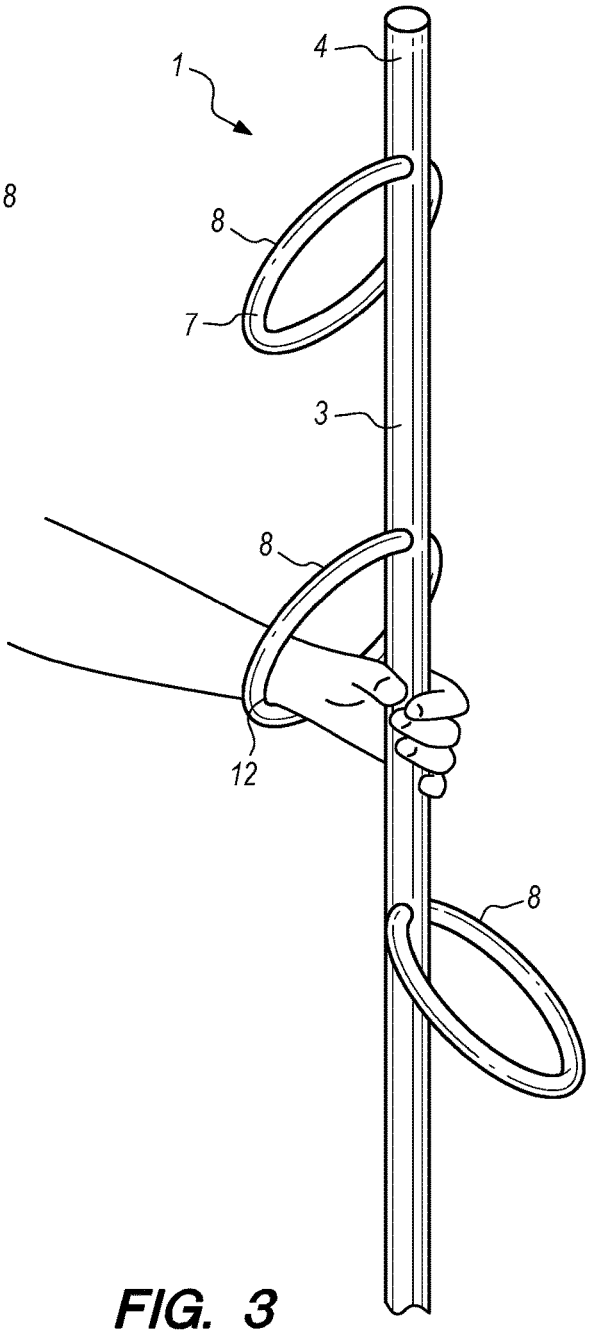
FIG. 3 is a drawing showing one embodiment of the mobility device of the present invention being grasped by a user.

As noted above, in the preferred embodiment of the mobility device 1 of the present invention the main support structure 3 is a sturdy vertical shaft, as shown in the figures. The main support structure 3 is intended to be grasped by the user, as shown in FIG. 3, and therefore, the diameter of the main support structure 3 is preferably sufficiently small such that the hand of the user can fit around the main support structure 3 when the mobility device 1 is being used, as described below. For example, the diameter of the main support structure 3 is preferably between one inch and one and one-eighth inches. Still, any number of diameters may be implemented so long as the main support structure 3 can be grasped comfortably by the user. The preferred methods of use of the main support structure 3 will be described more fully below.

A number of support appendages 8 are affixed to the main support structure 3. These support appendages 8 are configured to provide increased support to the user as the user grasps the main support structure 3 of the mobility device. The support appendages 8, for example, may be handles or other elements that provide increased support. In the preferred embodiment, the support appendages 8 are support rings 8 attached to the main support structure 3, as shown in the figures. In alternative embodiments, the support appendages 8 may be loops, cuffs, or other structures that can be used for support. A number of support rings 8 are attached to the main support structure 3 at spaced apart intervals to provide support means along the length of the main support structure 3. This provides the user with multiple suitable locations to grasp the main support structure 3. Furthermore, the use of support rings 8 allows the user to transfer his or her weight to the forearm area of the support arm and exert less pressure on the palm and fingers, as will be better understood with regard to the description of the preferred method of use of the mobility device 1 below. The support rings 8 act as a support for a point of contact on the user, as shown, for example, in FIG. 3.

Figure 2:
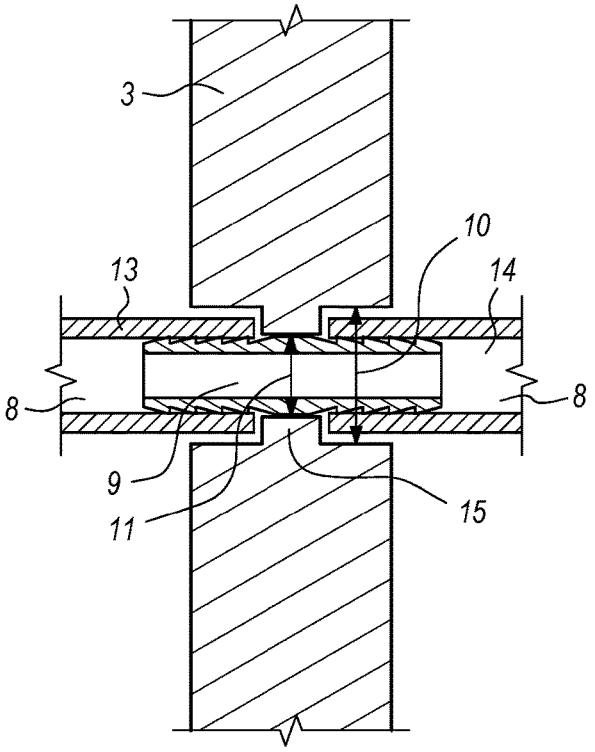
FIG. 2 is an internal cut-away view of one embodiment of the mobility device of the present invention showing the internal connection of the support appendage.

The support rings 8 are preferably affixed to the main support structure 3 such that each ring 8 extends outwardly from the axis of the support structure 3. In the preferred embodiment, the rings 8 are created by taking a flexible material (such as polyvinyl tube of 15/32 diameter, for example) having two ends 13, 14 and affixing one end 13 internally on a left side of the support structure 3 and affixing the other end 14 internally on a right side of the support structure 3 to create a generally ring-like shape of the flexible material, as shown in FIG. 2. In the preferred embodiment, the ends 13, 14 of the tube are connected end-to-end inside of the support structure 3 to create a connected circle of flexible material. The end-to-end connection of the flexible material may be by a barbed union 9, chemical bonding, adhesive, or a combination. Any method for connecting the flexible material end-to-end may be used so long as the connection remains secured such that the support rings 8 stay affixed inside and to the support structure 3.

In order for the flexible support rings 8 to be affixed internal to the support structure 3, the support structure must have a number of recesses 10 for receiving the flexible support ring material. These recesses 10 are drilled or machined along the length of the support structure 3, in spaced apart configurations corresponding to the desired placement of the support rings 8. The recesses 10 have a diameter that is preferably near to but slightly greater than the diameter of the ends 13, 14 of the support ring tubing such that the support ring 8 can easily be inserted to the recess 10 but still has a secure fit. In addition, the recesses 10 are configured such that they have this first diameter a certain depth on each side of the support structure 3, as shown in FIG. 2. The depth of the recesses 10 for this first diameter is configured such that there remains a portion 15 of the main support structure 3 that is not machined at this diameter, but instead the inner most portion 15 of the main support structure 3 is machined such that a smaller diameter aperture 11 connects the recess 10 on each side of the main support structure 3, as shown in FIG. 2.

For example, in the preferred embodiment, the main support structure 3 has a total diameter of one and one-eighth inches (1⅛ inches) and the support rings 8 are made of polyvinyl tubing having a diameter of 15⁄32 inches. The recesses 10 in the preferred embodiment may, for example, have a diameter of half an inch for a depth of half an inch on opposing sides of the main support structure 3 (thus leaving a remaining one-eighth inch inner portion 15 of main support structure 3 between the recesses 10). A smaller diameter aperture 11 (for example, 5⁄16 inches) is used to connect the half-inch diameter recesses 10. In on embodiment, this smaller diameter aperture 11 is sized to receive the connecting means (for example barbed union 9) to end-to-end connect the polyvinyl tubing. For example, a quarter inch nylon barbed union may be inserted into the 5⁄16 inch aperture such that the polyvinyl tubing may be connected to the barbed union. This series of varying size diameters allows the support ring 8 to be rotated vertically on the main support structure 3 while remaining affixed internally to the main support structure 3. The support rings 8 (other than the top most support ring 7, described below) can thus be rotated such that they extend from the main support structure 3 at various angles. These rings 8 can be rotated nearly 180 degrees from an upward position to a downward position (the downward position shown in FIGS. 1 and 3).

Sufficient flexible material is used such that the rings 8 created extend sufficiently from the main support structure 3 to allow the user's hand to be inserted through the ring 8 as it grasps the main support structure 3, as shown in FIG. 3. For example, a support ring 8 with a six inch outer diameter is preferable. In the preferred embodiment, three support rings 8 are used, but it is understood that any number of support rings 8 may be implemented along the main support structure 3. Furthermore, in one embodiment, one support ring 7 is located such that it is affixed toward the top end 4 of the support structure 3, allowing this top most support ring 7 to be rotated nearly completely, such that the top most ring 7 can be positioned on either side of the support structure 3. As the top most ring 7 rotates, the top most part 4 of the main support structure 3 passes through the support ring 7, allowing the user to change the side on which the top ring 7 hangs. This allows the mobility device 1 to be used by left-handed or right-handed users. In some embodiments, a foam cushion or other similar material may be wrapped around the main support structure at the points at which the support appendages hang, thereby providing increased comfort for the user when the user grasps the support structure.

The structure of the mobility device 1 of the present invention described above, the preferred method of use of the device 1 may now be described. The mobility device 1 of the present invention is intended to provide the user with a wider base of support than a traditional walking device (i.e. a cane) without changing the center of gravity of the user. This improved functionality is achieved based on the height of the main support structure 3 in connection with the support appendages 8 affixed to the main support structure 3. The main support structure 3 is intended to be grasped by the hand of the user, preferably with the user's hand to wrap around the substantial majority of the main support structure 3 as shown in FIG. 3.

In the preferred embodiment, the user inserts his or her hand through a support ring 8 affixed to the main support structure 3 and grasps the main support structure 3 with his or her hand. As the hand grasps the main support structure 3, a point of contact 12 on the user's wrist or forearm is supported by the support ring 8 that hangs from the main support structure 3 at the grasped location (an example is shown in FIG. 3 where the user has grasped the structure through the middle support ring 8 and the middle support ring 8 is supporting the user's wrist). In one embodiment, the user may use his or her other hand to grasp a different location on the main support structure 3 (and thus the user's other wrist or forearm may be supported by another support ring 8). With the support ring(s) 8 supporting the wrist(s) or forearm(s) of the user, weight is transferred to the forearm area of the user, which exerts less pressure on the palm and fingers. The flexibility of the support ring 8 allows the ring to contour to any size or shape forearm for maximum comfort.

The mobility device may be particularly useful when the user desires to move from a sitting position to a standing position. In one embodiment, a user in a sitting position may use one hand to grasp the main support structure 3 at a higher position and the other hand to grasp the main support structure 3 at a lower position in the manner described above with regard to inserting the hands through the support rings. Because the main support structure 3 has a height near the height of the user when standing, when the user is in the sitting position, the support structure 3 may be grasped in a location or locations that are above the sitting user. The user may then use the support structure 3 to "pull" himself or herself from the sitting position into a standing position. The integration of multiple support appendages 8 on the support main support structure 3 also provide an improved device 1 for moving up and down stairs. The multiple locations of support rings 8 at different heights on the main support structure 3 allow the user to hold the staff 3 with the support arm at or near level and from one or two steps below or above the direction of travel. Finally, the height of the support staff 3 allows the staff 3 to be grasped by the user at a comfortable position when walking, using stairs, or moving from a seated position to a standing position.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification. When a range is stated herein, the range is intended to include all sub-ranges within the range, as well as all individual points within the range. When "about," "approximately," or like terms are used herein, they are intended to include amounts, measurements, or the like that do not depart significantly from the expressly stated amount, measurement, or the like, such that the stated purpose of the apparatus or process is not lost.

The present invention has been described with reference to certain preferred and alternative embodiments that are intended to be exemplary only and not limiting to the full scope of the present invention, as set forth in the appended claims.

I claim:

1. A device for improving the mobility of a user, the device comprising:

a. an elongated main support structure having an upper end and a lower end opposite the upper end;

b. a plurality of support appendages affixed to the main support structure, the plurality of support appendages comprising:

i. a first support appendage affixed between the upper end and the lower end of the main support structure and extending outwardly from the main support structure in a first direction;

ii. a second support appendage affixed between the upper end and the lower end of the main support structure and extending from the main support structure in a second direction; and iii. an upper support appendage affixed at the upper end of the main support structure, wherein the upper support appendage is configured to rotate such that it extends from the main support structure in either the first direction or the second direction wherein the main support structure is configured to be grasped by the user and wherein at least one of the plurality of support appendages is configured to support a point of contact on the user when the main support structure is grasped by the user.

2. The device of claim 1, wherein each support appendage comprises a ring.

3. The device of claim 2, wherein each ring comprises a polyvinyl tube.

4. The device of claim 1, wherein the support appendages are affixed to the main support structure through an aperture in the main support structure.

5. The device of claim 1, wherein the main support structure is a wooden shaft.

6. The device of claim 1, wherein the lower end of the main support structure is configured to provide a point of contact on a walking surface.

7. The device of claim 1, wherein at least one of the support appendages is configured to receive an appendage of the user when the user grasps the main support structure.

8. The device of claim 1, wherein at least one of the plurality of support appendages is configured to support a wrist of the user when the main support structure is grasped by the user.

9. The device of claim 1, wherein at least one of the plurality of support appendages is configured to support a forearm of the user when the main support structure is grasped by the user.

10. A device for improving the mobility of a user, the device comprising:

a. a shaft having an upper end and a lower end, the lower end of the shaft configured to provide a point of contact with a walking surface;

b. a first support ring rotatably affixed between the upper end and the lower end of the shaft, wherein the first support ring is positioned on a first side of the shaft, and wherein the first support ring is configured to rotate between a lower position and an upper position on the first side of the shaft;

c. a second support ring rotatably affixed between the upper end and the lower end of the shaft, wherein the first support ring is positioned on a second side of the shaft, wherein the second side is opposite the first side, and wherein the second support ring is configured to rotate between a lower position and an upper position on the second side of the shaft; and d. an upper support ring rotatably affixed to the upper end shaft, the upper support ring configured to rotate between the first side and the second side of the shaft such that the upper support is configured to change position between the first side and the second side of the shaft.

11. The device of claim 10, wherein the first support ring, second support ring, and third support ring comprise polyvinyl tubing.

12. The device of claim 10, wherein the shaft comprises wood.

* * * * *